US009520082B2

(12) United States Patent
Choi et al.

(10) Patent No.: US 9,520,082 B2
(45) Date of Patent: Dec. 13, 2016

(54) ORGANIC LIGHT EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Yang-Hwa Choi, Yongin (KR); Cheol-Min Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 189 days.

(21) Appl. No.: 14/033,394

(22) Filed: Sep. 20, 2013

(65) Prior Publication Data

US 2014/0292624 A1 Oct. 2, 2014

(30) Foreign Application Priority Data

Apr. 2, 2013 (KR) ..... 10-2013-0035918

(51) Int. Cl.
*G09G 3/3233* (2016.01)
*G09G 3/32* (2016.01)

(52) U.S. Cl.
CPC ..... *G09G 3/3233* (2013.01); *G09G 2300/043* (2013.01); *G09G 2300/0819* (2013.01); *G09G 2300/0842* (2013.01); *G09G 2300/0861* (2013.01); *G09G 2320/029* (2013.01); *G09G 2320/0285* (2013.01); *G09G 2320/045* (2013.01); *G09G 2360/16* (2013.01)

(58) Field of Classification Search
CPC ..... G09G 3/3208; G09G 2320/045; G09G 2320/043
See application file for complete search history.

(56) References Cited

U.S. PATENT DOCUMENTS

2005/0110720 A1* 5/2005 Akimoto et al. ..... 345/76
2006/0097966 A1* 5/2006 Choi ..... 345/77
2009/0027423 A1* 1/2009 Kwon ..... G09G 3/3233 345/690
2009/0184896 A1* 7/2009 Kwon ..... 345/76
2010/0020051 A1 1/2010 Kim et al.
2011/0164010 A1* 7/2011 Yamamoto ..... G09G 3/3233 345/207
2011/0210958 A1* 9/2011 Yoo et al. ..... 345/214
2011/0216056 A1 9/2011 Yoo et al.
2011/0279437 A1* 11/2011 Komiya ..... G09G 3/3233 345/212

FOREIGN PATENT DOCUMENTS

KR 10-2010-0012247 A 2/2010
KR 10-2011-0099581 A 9/2011

* cited by examiner

*Primary Examiner* — Andrew Sasinowski
*Assistant Examiner* — Chun-Nan Lin
(74) *Attorney, Agent, or Firm* — Lewis Roca Rothgerber Christie LLP

(57) ABSTRACT

An organic light emitting display device includes: pixels at crossing regions of data lines and scan lines, each of the pixels including an organic light emitting diode (OLED); a scan driver configured to drive the scan lines; a data driver configured to drive the data lines; a control line driving unit configured to drive control lines; and a compensation unit configured to extract at least one of deterioration information of the OLED or threshold voltage information of a driving transistor from at least one of the pixels during a sensing period. The data driver is further configured to supply a same first data signal to each of the pixels other than the at least one of the pixels in the sensing period.

6 Claims, 6 Drawing Sheets

ORGANIC LIGHT EMITTING DISPLAY DEVICE AND METHOD OF DRIVING THE SAME

CROSS-REFERENCE TO RELATED APPLICATIONS

This application claims priority to and the benefit of Korean Patent Application No. 10-2013-0035918, filed in the Korean Intellectual Property Office on Apr. 2, 2013, the entire content of which is incorporated herein by reference.

BACKGROUND

1. Field

Aspects of embodiments of the present invention relate to an organic light emitting display device and a method of driving the organic light emitting display device.

2. Description of the Related Art

Recently, various flat panel display devices having reduced weight and volume, when compared to those of comparable cathode ray tube devices, have been developed. Flat panel display devices include liquid crystal displays, field emission displays, plasma display panels, organic light emitting display devices, and the like.

Among the flat panel display devices, organic light emitting display devices display images using organic light emitting diodes (OLEDs) that generate light by recombination between electrons and holes. Organic light emitting display devices have features such as rapid response speed and low power consumption.

SUMMARY

Embodiments of the present invention relate to an organic light emitting display device and a method of driving the organic light emitting display device.

In an embodiment of the present invention, an organic light emitting display device is provided. The organic light emitting display device includes: pixels at crossing regions of data lines and scan lines, each of the pixels including an organic light emitting diode (OLED); a scan driver configured to drive the scan lines; a data driver configured to drive the data lines; a control line driving unit configured to drive control lines; and a compensation unit configured to extract at least one of deterioration information of the OLED or threshold voltage information of a driving transistor from at least one of the pixels during a sensing period. The data driver is further configured to supply a same first data signal to each of the pixels other than the at least one of the pixels in the sensing period.

The first data signal may be a white data signal.

The organic light emitting display device may further include a timing controller configured to convert at least a portion of image data supplied from the outside to correspond to the at least one of the deterioration information or the threshold voltage information, and to supply the converted image data to the data driver.

Each of the pixels on an i-th (i indicates a natural number) horizontal line may include: an OLED; a driving transistor configured to control an amount of current supplied from a first power supply to the OLED; a first transistor coupled between one of the data lines and a gate electrode of the driving transistor, and configured to turn on when a scan signal is supplied to an i-th scan line of the scan lines; a third transistor coupled between the driving transistor and an anode electrode of the OLED, and configured to turn off when an emission control signal is supplied to an i-th emission control line and to turn on in other cases; a fourth transistor coupled between the anode electrode of the OLED and the one of the data lines, and configured to turn on when a control signal is supplied to an i-th control line of the control lines; and a storage capacitor coupled between the first power supply and the gate electrode of the driving transistor.

In another embodiment of the present invention, a method of driving an organic light emitting display device is provided. The method includes: extracting at least one of deterioration information of an organic light emitting diode (OLED) or threshold voltage information of a driving transistor from a first pixel of the display device through a data line during a sensing period; and supplying a same data signal to pixels of the display device other than the first pixel during the sensing period.

The same data signal may be a white data signal.

The other pixels may be set in an emission state during the sensing period.

The other pixels may be set in a non emission state during the sensing period.

BRIEF DESCRIPTION OF THE DRAWINGS

Example embodiments of the present invention will now be described more fully hereinafter with reference to the accompanying drawings; however, the present invention may be embodied in different forms and should not be construed as limited to the embodiments set forth herein. Rather, these embodiments are provided to more fully convey the scope of the present invention to those skilled in the art.

In the drawings, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
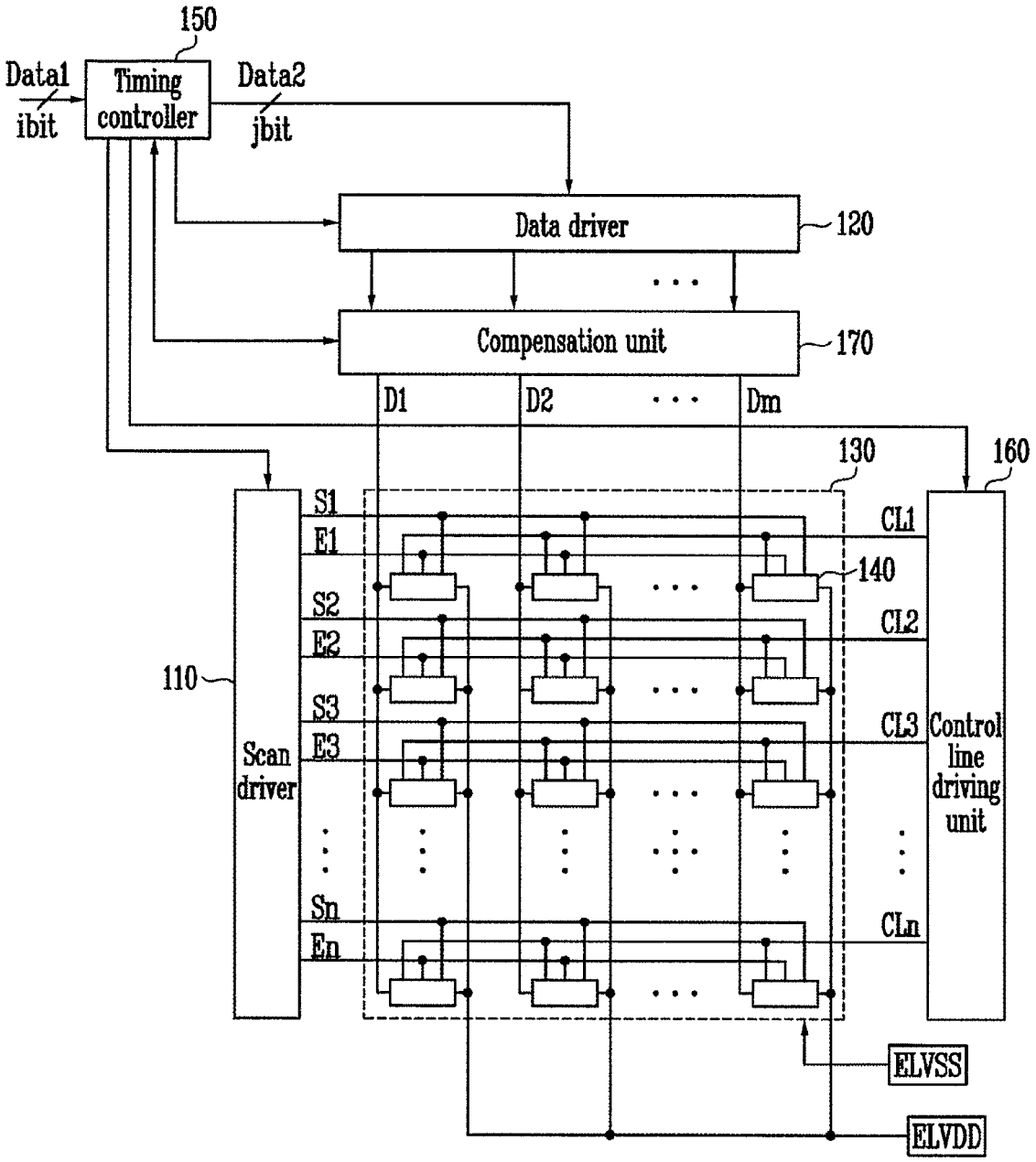
FIG. 1 is a schematic view showing an organic light emitting display device according to an embodiment of the present invention.

In the following detailed description, only certain embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "on" another element, it can be directly on the other element or be indirectly on the other element with one or more intervening elements interposed therebetween. In addition, when an element is referred to as being "connected to" or "coupled to" another element, it can be directly coupled to (e.g., connected to) the other element or be indirectly coupled to (e.g., electrically connected to) the other element with one or more intervening elements interposed therebetween. Hereinafter, like reference numerals refer to like elements.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

FIG. 1 is a schematic view showing an organic light emitting display device according to an embodiment of the present invention.

Referring to FIG. 1, the organic light emitting display device includes a display unit 130 including pixels 140 positioned at crossing regions of scan lines S1 to Sn and data lines D1 to Dm, a scan driver 110 for driving the scan lines S1 to Sn and emission control lines E1 to En, and a control line driving unit 160 for driving control lines CL1 to CLn.

In addition, the organic light emitting display device includes a data driver 120 for supplying data signals to the data lines D1 to Dm, a compensation unit 170 for extracting deterioration information of an organic light emitting diode (OLED) and/or threshold voltage information of a driving transistor from the pixels 140, and a timing controller 150 for controlling the scan driver 110, the data driver 120, and the control line driving unit 160 as well as the compensation unit 170.

The display unit 130 includes the pixels 140 positioned at crossing regions of the scan lines S1 to Sn and the data lines D1 to Dm. The pixels 140 receive power from a first power supply ELVDD and a second power supply ELVSS supplied from the outside. The pixels 140 control an amount of current flowing from the first power supply ELVDD to the second power supply ELVSS through the OLEDs corresponding to the data signals.

The scan driver 110 supplies the scan signals to the scan lines S1 to Sn and supplies the emission control signals to the emission control lines E1 to En under control of the timing controller 150. For example, the timing controller 150 may control the scan driver 110 to sequentially supply the scan signals to the scan lines S1 to Sn and to sequentially supply the emission control signals to the emission control lines E1 to En. Here, each scan signal is set to a voltage capable of turning on a transistor included in each of the pixels 140, and each emission control signal is set to a voltage capable of turning off a transistor included in each of the pixels 140.

The control line driving unit 160 supplies the control signals to the control lines CL1 to CLn under control of the timing controller 150. Here, the control signals are supplied in a sensing period when the deterioration information and/or threshold voltage information is extracted.

The data driver 120 generates the data signals by using second data Data2 supplied from the timing controller 150, and supplies the generated data signals to the data lines D1 to Dm.

The compensation unit 170 extracts the deterioration information and/or threshold voltage information from each pixel 140. For example, the compensation unit 170 is coupled to each pixel 140 through the data lines D1 to Dm in the sensing period, and extracts the deterioration information and/or threshold voltage information from each pixel 140 corresponding to the control signals CL1 to CLn. The extracted deterioration information and/or threshold voltage information is supplied from the compensation unit 170 to the timing controller 150. In addition, the compensation unit 170 couples the data lines D1 to Dm to the data driver 120 in a driving period for displaying a set image (for example, a predetermined image) in the display unit 130. The compensation unit 170 may be formed in various structures, such as any one of known structures to one of ordinary skill in the art, to extract the deterioration information and/or threshold voltage information.

The timing controller 150 controls the scan driver 110, the data driver 120, the control line driving unit 160, and the compensation unit 170. In addition, the timing controller 150 converts a bit value of first data Data1 input from the outside to compensate for the deterioration and/or the threshold voltage of the corresponding pixels 140. This compensation, for example, may correspond to the deterioration information extracted earlier, which the timing controller 150 applies to the first data Data1 to generate the second data Data2. Here, the first data Data1 uses i bits (i is a natural number) per data signal, and the second data Data2 uses j bits a is a natural number more than i) per data signal.

Figure 2:
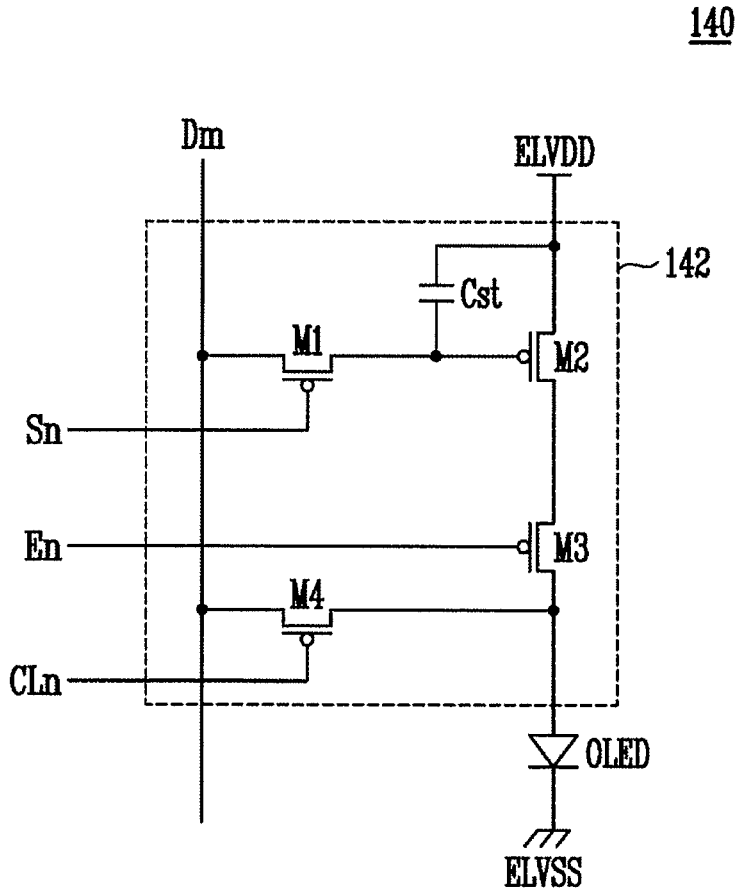
FIG. 2 is a schematic view showing an example pixel of the organic light emitting display device of FIG. 1.

FIG. 2 is a schematic view showing an example pixel 140 of the organic light emitting display device of FIG. 1. For convenience of description, in FIG. 2, the pixel 140 is coupled to an n-th scan line Sn, emission control line En, and control line CLn along with an m-th data line Dm.

Referring to FIG. 2, the pixel 140 includes an OLED and a pixel circuit 142 supplying current to the OLED. An anode electrode of the OLED is coupled to the pixel circuit 142, and a cathode electrode thereof is coupled to the second power supply ELVSS. The OLED generates light having a set brightness (for example, a predetermined brightness) corresponding to current supplied from the pixel circuit 142.

The pixel circuit 142 receives a data signal supplied from the data line Dm when a scan signal is supplied to the scan line Sn. The pixel circuit 142 is coupled to the data line Dm when the scan signal is supplied to the scan line Sn. The pixel circuit 142 supplies the deterioration information and/or threshold voltage information to the compensation unit 170 through the data line Dm in a sensing period when the control signal is supplied to the control line CLn. To this end, the pixel circuit 142 includes four transistors M1 to M4 and a storage capacitor Cst.

A gate electrode of the first transistor M1 is coupled to the scan line Sn, and a first electrode thereof is coupled to the data line Dm. In addition, a second electrode of the first transistor M1 is coupled to a first terminal of the storage capacitor Cst. The first transistor M1 is turned on when the scan signal is supplied to the scan line Sn. Here, the scan signals are supplied to the first transistor M1 in a period in which a voltage corresponding to the data signal is charged in the storage capacitor Cst.

A gate electrode of the second transistor (or driving transistor) M2 is coupled to the first terminal of the storage capacitor Cst, and a first electrode thereof is coupled to a second terminal of the storage capacitor Cst and the first power supply ELVDD. The second transistor M2 controls an amount of current flowing from the first power supply ELVDD to the second power supply ELVSS through the OLED corresponding to the voltage value stored in the storage capacitor Cst. Here, the OLED generates light corresponding to the amount of current supplied from the second transistor M2.

A gate electrode of the third transistor M3 is coupled to the emission control line En, and a first electrode thereof is coupled to a second electrode of the second transistor M2. In addition, the second electrode of the third transistor M3 is coupled to the OLED. The third transistor M3 is turned off when the emission control signal is supplied to the emission control line En, and is turned on when the emission control signal is not supplied thereto.

A gate electrode of the fourth transistor M4 is coupled to the control line CLn, and a first electrode thereof is coupled to the second electrode of the third transistor M3. In addition, a second electrode of the fourth transistor M4 is coupled to the data line Dm. The fourth transistor M4 is turned on when the control signal is supplied to the control line CLn, and is turned off in other cases.

The structure of the pixel 140 is not limited to the above description of FIG. 2. The pixel 140 may be applied in various forms including the fourth transistor M4 to extract the deterioration information and/or threshold voltage information. For example, the structure of the pixel 140 may be any one of various pixel structures known to one of ordinary skill in the art.

Figure 3:
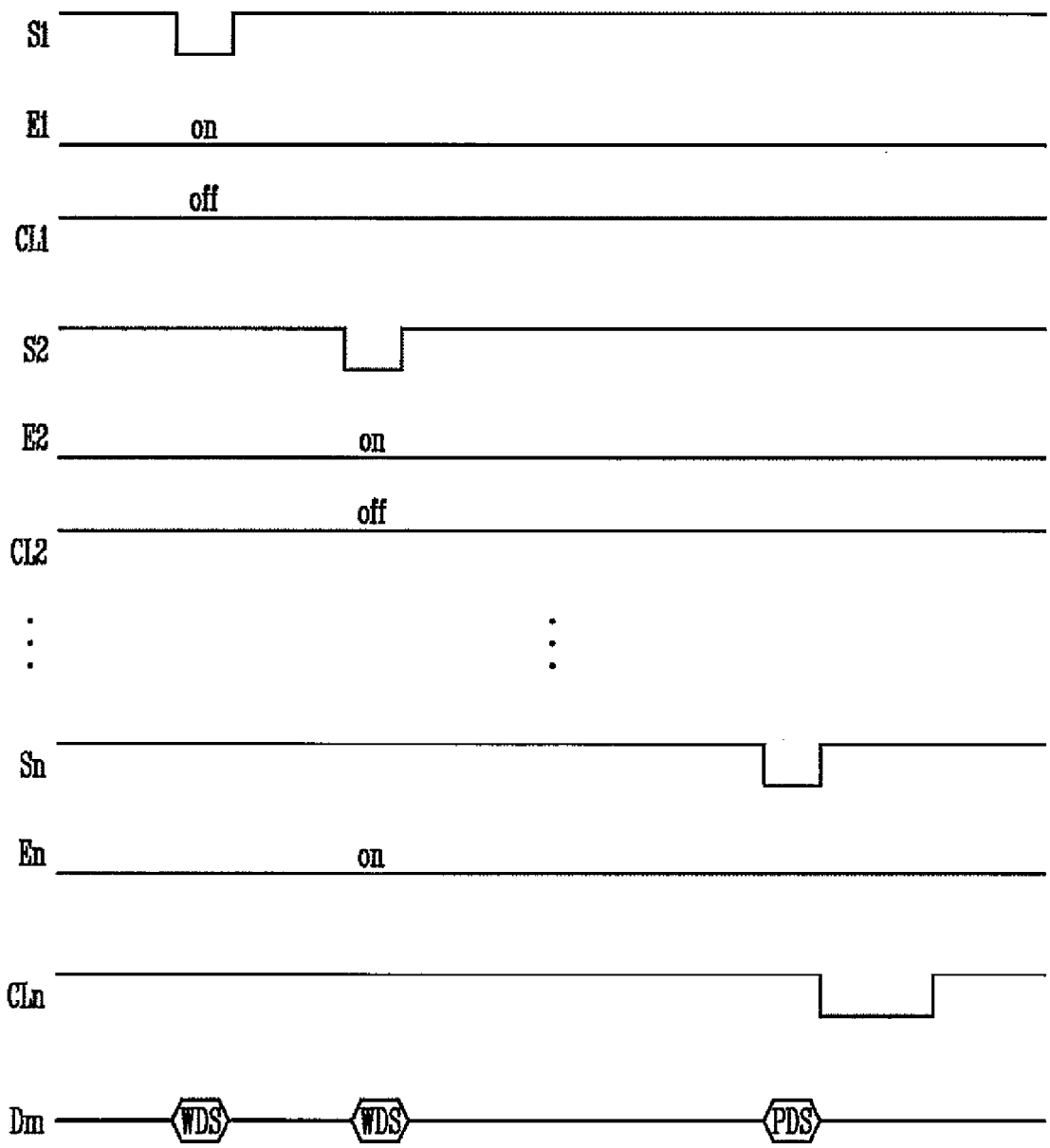
FIG. 3 is a waveform diagram showing a method of extracting threshold voltage information of a driving transistor during a sensing period according to a first embodiment of the present invention.

FIG. 3 is a waveform diagram showing a method of extracting threshold voltage information of a driving transistor during a sensing period according to a first embodiment of the present invention. In FIG. 3, it is assumed that threshold voltage information is extracted from the pixel coupled to an n-th scan line Sn and an m-th data line Dm, for convenience of description. In other embodiments, threshold voltage information is concurrently extracted from all the pixels coupled to the same scan line.

Referring to FIG. 3, the scan signals are sequentially supplied to the scan lines S1 to Sn in a sensing period, the data signal is supplied to the data line Dm to synchronize with the scan signal. Here, the other pixels except the pixel 140 in which the threshold voltage information is extracted receive the same data signals, for example, white data signals (WDS). Further, in order to stably extract the threshold voltage, a set data signal (such as a predetermined data signal PDS) is supplied to the pixel 140 that is positioned on the n-th horizontal line where the threshold voltage information is extracted.

After supplying the predetermined data signal PDS to the pixel 140 positioned on the n-th horizontal line, the control signal is supplied to the n-th control line CLn. When the control signal is supplied to the n-th control line CLn, the fourth transistor M4 included in the pixel 140 that is positioned on n-th horizontal line is turned on. Then, current is supplied from the driving transistor M2 to the compensation unit 170 through the data line Dm corresponding to the predetermined data signal PDS. Here, the current supplied from the driving transistor M2 corresponding to the predetermined data signal PDS is changed by an amount of current corresponding to the threshold voltage. Accordingly, the current supplied from the driving transistor M2 to the compensation unit 170 through the data line Dm corresponding to the predetermined data signal PDS is included in the threshold voltage information. The compensation unit 170 converts the current supplied from the pixel 140 to a digital signal, and the converted digital signal is supplied to the timing controller 150 as a threshold voltage or other threshold voltage information. The predetermined data signal PDS may be set, for example, as a white data signal corresponding to any one of multiple grayscales.

Figure 4:
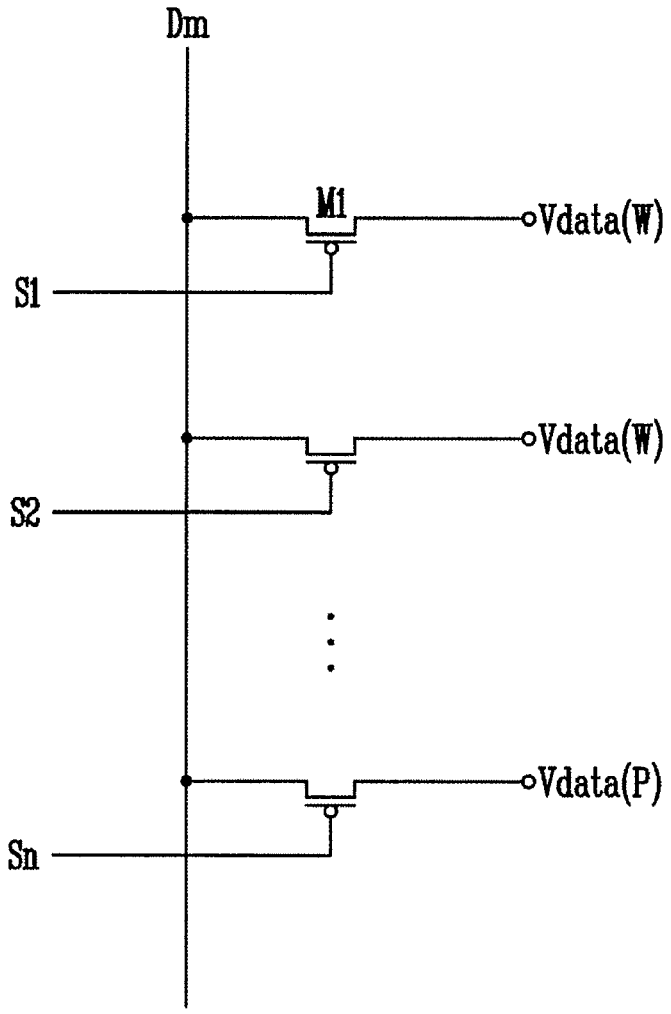
FIG. 4 is a schematic view showing voltage applied to the pixels according to the waveform of driving shown in FIG. 3.

Meanwhile, during the sensing period, the other pixels except the pixel 140 in which the threshold voltage information is extracted receive the white data signal WDS as shown in FIG. 4. Here, the white data signal WDS is a data signal for implementing a bright grayscale and it is set to a low voltage Vdata (W). For example, the white data signal WDS is set to 8V, a black data signal may set to 15V. Here, the predetermined data signal PDS is set to a specific voltage Vdata (P) from 8V to 15V.

When the white data signal WDS is supplied to the other pixels, voltage differences between the data line Dm and the first transistors M1 of each of the other pixels coupled to the data line Dm is reduced or minimized, thereby reducing the leakage current. In other words, the data line Dm is maintained at a low voltage during the sensing period when current is supplied from the pixel 140 that receives the predetermined data signal PDS to the compensation unit 170 through the data line Dm. Therefore, the white data signal WDS is supplied to the other pixels to reduce or minimize leakage current. Accordingly, the accuracy of the threshold voltage information extracted from the pixel that receives the predetermined data signal PDS is improved, which provides for higher reliability compensation.

Figure 5:
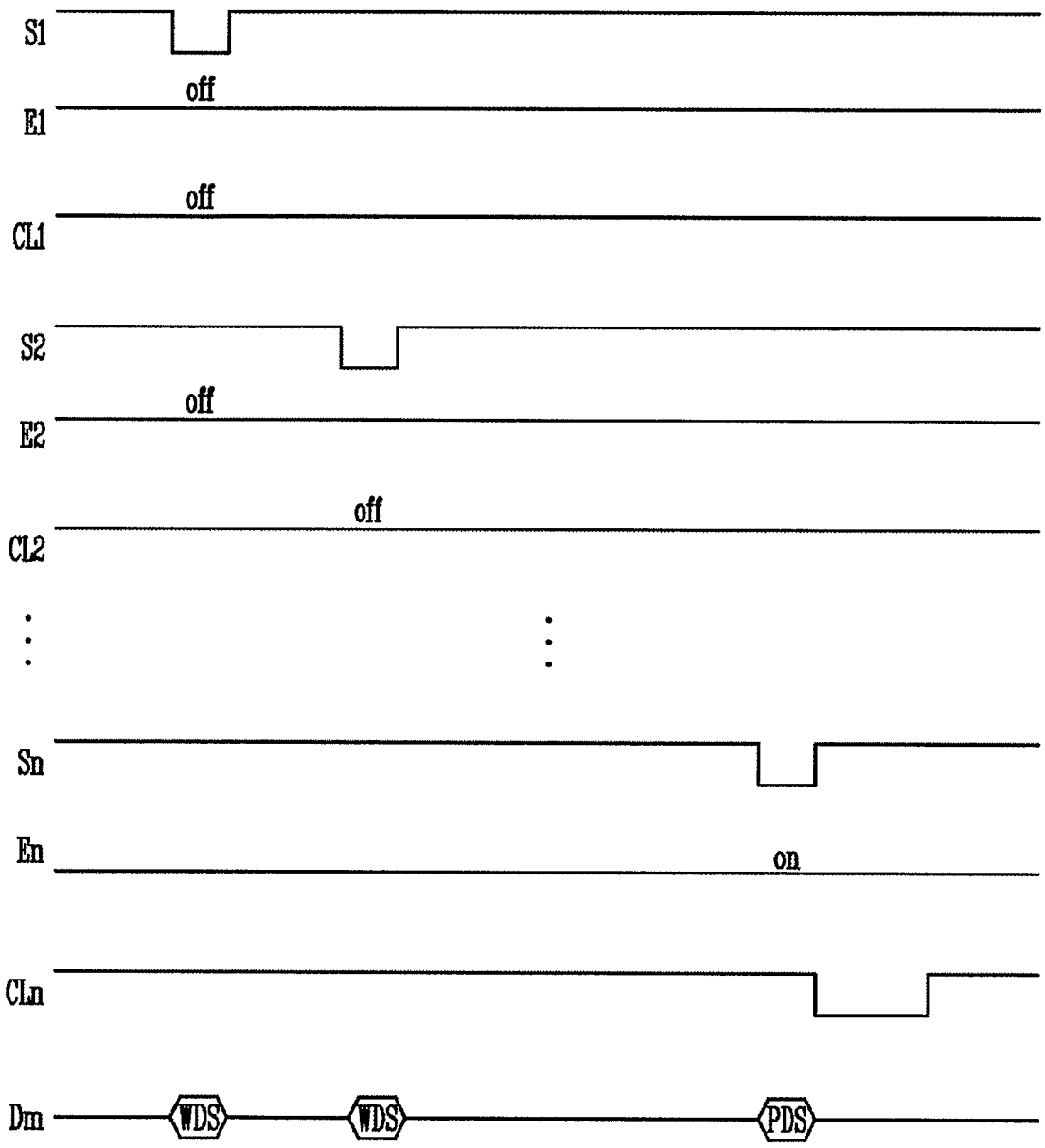
FIG. 5 is a waveform diagram showing a method of extracting threshold voltage information of a driving transistor during a sensing period according to a second embodiment of the present invention.

In the waveform of FIG. 3, the other pixels except the pixel 140 that receives the predetermined data signal PDS emit white, which can be seen by an observer. Therefore, in another embodiment illustrated in FIG. 5, the emission control signal is supplied to the i-th emission control line Ei (where i is a natural number less than n) to overlap the scan signal supplied to the i-th scan line Si as shown in FIG. 5. Then, although the white data signal WDS is supplied to the other pixels, the other pixels are set in a non emission state. The sensing period may be arranged at a time of supplying power to the organic light emitting display device or not supplying power to the other pixels in order to not be observed by an observer.

Figure 6:
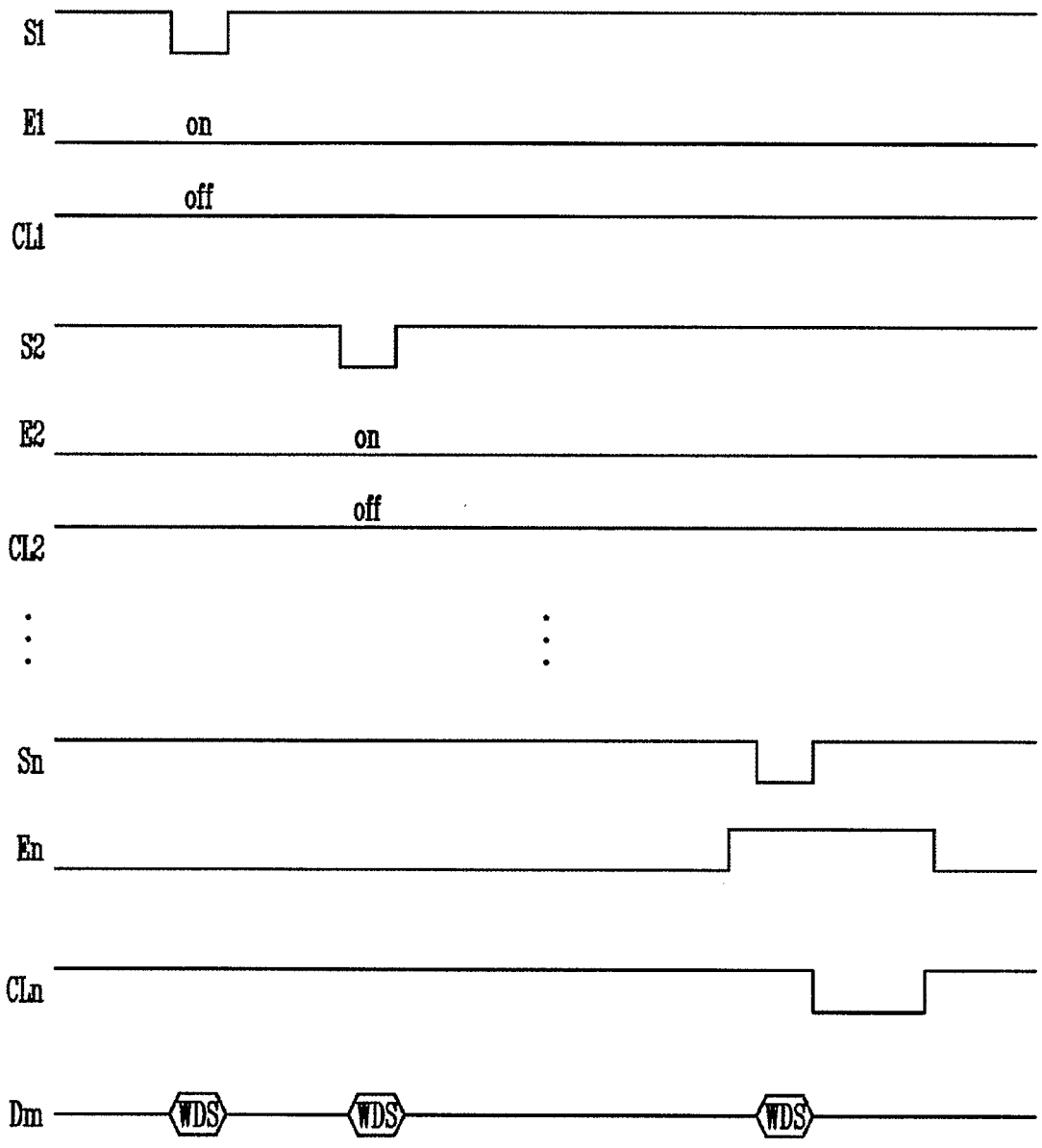
FIG. 6 is a waveform diagram showing a method of extracting deterioration information of an organic light emitting display device during a sensing period according an embodiment of the present invention.

FIG. 6 is a waveform diagram showing a method of extracting deterioration information of an organic light emitting display device during a sensing period according an embodiment of the present invention. In FIG. 6, it is assumed that deterioration information of an OLED is extracted from the pixel coupled to an n-th scan line Sn and an m-th data line Dm, for convenience of description. In other embodiments, deterioration information is concurrently extracted from all the pixels coupled to the same scan line.

Referring to FIG. 6, the same data signals, for example, white data signals WDS, are supplied to all the pixels during the sensing period when the deterioration information is extracted. Here, the emission control signal is supplied to the n-th emission control line En to overlap the scan signal that is supplied to the n-th scan line Sn coupled to the pixel 140 from which the deterioration information is extracted. When the emission control signal is supplied to the n-th emission control line En, the third transistor M3 that is included in the pixels positioned on the n-th horizontal line are turned off.

After that, when the control signal is supplied to the n-th control line CLn, the fourth transistor M4 in the pixel 140 from which the deterioration information is extracted is turned on. When the fourth transistor M4 is turned on, the data line Dm and the OLED are electrically coupled to each other. Then, corresponding to the current supplied from the compensation unit 170, a set voltage (for example, a predetermined voltage) is applied to the OLED, and the voltage at the OLED is then supplied to the compensation unit 170 as deterioration information. The compensation unit 170 converts this voltage supplied from the OLED to a digital signal, and the converted digital signal is supplied to the timing controller 150 as deterioration information of the OLED. Meanwhile, the emission control signal may be supplied to the i-th emission control line Ei to overlap the scan signal supplied to the i-th scan line Si as shown in FIG. 5 such that the other pixels are in a non emission state during the sensing period when deterioration information is extracted.

In the above-described embodiments of the present invention, white data signals are supplied to the other pixels in the sensing period when the deterioration information and/or threshold voltage information are extracted from the pixel of interest. Therefore, the leakage current from the other pixels to the data line is reduced or minimized, thereby making it possible to improve reliability of deterioration information and/or threshold voltage information.

In the above embodiments, the transistors are shown as P-channel metal oxide semiconductor (PMOS) transistors for convenience of description, but the present invention is not limited thereto. In other embodiments, for example, the transistors may be formed as N-channel metal oxide semiconductor (NMOS) transistors.

In addition, in some embodiments, the OLED generates red light, green light, or blue light corresponding to an amount of current supplied from the driving transistor, but the present invention is not limited thereto. For example, in other embodiments, the OLED as described above generates white light corresponding to an amount of current supplied from the driving transistor. In these embodiments, for example, color images may be implemented by using separate color filters, or the like.

By way of summation and review, the organic light emitting display device displays a desired image while the device supplies current corresponding to the data signal to the OLED disposed on every pixel. However, the OLED deteriorates over time, therefore, a problem in which a desired image brightness cannot be displayed occurs. The more the OLED deteriorates, the lower the brightness that is generated corresponding to the same data signal.

In order to overcome the problem, a method has been proposed that deterioration information of the OLED from each pixel is extracted and the input image data is changed corresponding to the extracted deterioration information to thereby compensate for the deterioration. However, the method of compensating deterioration has a problem that reliability thereof is decreased due to leakage current of pixels other than the pixel that extracts the deterioration information.

As set force above, in embodiments of the present invention, the same data signals for example, white data signals, are supplied to pixels other than the pixel from which deterioration information and/or threshold voltage information are/is extracted. Here, when the white data signals are supplied to the other pixels, voltage differences between the data lines and the other pixels are reduced or minimized, therefore, leakage current of the other pixels can be reduced or minimized. That is, in embodiments of the present invention, leakage current of the other pixels is reduced or minimized, thereby making it possible to improve reliability of the information to be extracted.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. An organic light emitting display device comprising:

pixels at crossing regions of data lines and scan lines, each of the pixels comprising an organic light emitting diode (OLED);

a scan driver configured to drive the scan lines;

a data driver configured to drive the data lines;

a control line driving unit configured to drive control lines during a sensing period for extracting pixel information comprising at least one of deterioration information of the OLED or threshold voltage information of a driving transistor from each of the pixels; and a compensation unit configured to extract the pixel information from each of the pixels including a first one of the pixels and a second one of the pixels during the sensing period, the first and second ones of the pixels being coupled to a first one of the data lines, wherein, during the sensing period, the data driver is further configured to:

supply a white data signal to each of the pixels coupled to the first one of the data lines other than the first one of the pixels and supply a specific data signal different from the white data signal to the first one of the pixels before the extracting of the pixel information from the first one of the pixels; and supply the white data signal to each of the pixels coupled to the first one of the data lines other than the second one of the pixels and supply the specific data signal to the second one of the pixels after the extracting of the pixel information from the first one of the pixels and before the extracting of the pixel information from the second one of the pixels.

2. The organic light emitting display device of claim 1 further comprising a timing controller configured to convert at least a portion of image data supplied from the outside to correspond to the at least one of the deterioration information or the threshold voltage information, and to supply the converted image data to the data driver.

3. The organic light emitting display device of claim 1, wherein each of the pixels on an i-th (i indicates a natural number) horizontal line comprises:

an OLED;

a driving transistor configured to control an amount of current supplied from a first power supply to the OLED;

a first transistor coupled between one of the data lines and a gate electrode of the driving transistor, and configured to turn on when a scan signal is supplied to an i-th scan line of the scan lines;

a third transistor coupled between the driving transistor and an anode electrode of the OLED, and configured to turn off when an emission control signal is supplied to an i-th emission control line and to turn on in other cases;

a fourth transistor coupled between the anode electrode of the OLED and the one of the data lines, and configured to turn on when a control signal is supplied to an i-th control line of the control lines; and a storage capacitor coupled between the first power supply and the gate electrode of the driving transistor.

4. A method of driving an organic light emitting display device comprising pixels coupled to data lines, a first one of the pixels and a second ones of the pixels being coupled to a first one of the data lines, the method comprising:

extracting pixel information comprising at least one of deterioration information of an organic light emitting diode (OLED) or threshold voltage information of a driving transistor from each of the pixels during a sensing period, comprising:

supplying a white data signal to each of the pixels coupled to the first one of the data lines other than the first one of the pixels, supplying a specific data signal different from the white data signal to the first one of the pixels, and then extracting the pixel information from the first one of the pixels;

supplying the white data signal to each of the pixels coupled to the first one of the data lines other than the second one of the pixels and supplying the specific data signal to the second one of the pixels after the extracting of the pixel information from the first one of the pixels; and then extracting the pixel information from the second one of the pixels.

5. The method of claim 4, wherein the pixels being supplied the white data signal are set in an emission state during the sensing period.

6. The method of claim 4, wherein the pixels being supplied the white data signal are set in a non emission state during the sensing period.

* * * * *